US007493978B2

(12) United States Patent
Nakamura et al.

(10) Patent No.: US 7,493,978 B2
(45) Date of Patent: Feb. 24, 2009

(54) TRAVELING HYDRAULIC WORKING MACHINE

(75) Inventors: Tsuyoshi Nakamura, Ibaraki-ken (JP); Genroku Sugiyama, Ryuugasaki (JP); Kazunori Nakamura, Tsuchiura (JP); Toichi Hirata, Ushiku (JP)

(73) Assignee: Hitachi Construction Machinery Co., Ltd, Tokyo (JP)

( * ) Notice: Subject to any disclaimer, the term of this patent is extended or adjusted under 35 U.S.C. 154(b) by 516 days.

(21) Appl. No.: 10/541,450

(22) PCT Filed: Jul. 30, 2004

(86) PCT No.: PCT/JP2004/011305

§ 371 (c)(1),
(2), (4) Date: Jul. 6, 2005

(87) PCT Pub. No.: WO2005/012711

PCT Pub. Date: Oct. 2, 2005

(65) Prior Publication Data

US 2006/0113140 A1 Jun. 1, 2006

(30) Foreign Application Priority Data

Aug. 1, 2003 (JP) ..... 2003-285144

(51) Int. Cl.
*F02D 29/04* (2006.01)

(52) U.S. Cl. ..... 180/53.4

(58) Field of Classification Search ..... 180/53.4, 180/305, 306; 701/48, 50; 60/422, 459
See application file for complete search history.

(56) References Cited

U.S. PATENT DOCUMENTS

| | | | | | |
|---|---|---|---|---|---|
| 4,846,046 | A * | 7/1989 | Kanai et al. | ..... | 60/494 |
| 4,898,333 | A * | 2/1990 | Kime et al. | ..... | 180/53.4 |
| 5,694,317 | A * | 12/1997 | Nakagami et al. | ..... | 701/50 |
| 5,911,506 | A * | 6/1999 | Nakamura et al. | ..... | 37/348 |
| 5,983,151 | A * | 11/1999 | Okada et al. | ..... | 701/50 |
| 5,984,018 | A * | 11/1999 | Yamamoto et al. | ..... | 701/50 |
| 6,016,875 | A * | 1/2000 | Orbach et al. | ..... | 701/50 |
| 6,321,153 | B1 * | 11/2001 | Rocke et al. | ..... | 701/50 |
| 6,879,899 | B2 * | 4/2005 | Budde | ..... | 701/50 |

FOREIGN PATENT DOCUMENTS

| | | |
|---|---|---|
| JP | 63-4131 | 1/1988 |
| JP | 64-62525 | 3/1989 |
| JP | 3-286045 | 12/1991 |
| JP | 5-295760 | 11/1993 |
| JP | 8-30427 | 3/1996 |
| JP | 8-30429 | 3/1996 |

* cited by examiner

*Primary Examiner*—Frank B Vanaman
(74) *Attorney, Agent, or Firm*—Mattingly, Stanger, Malur & Brundidge, PC

(57) ABSTRACT

A traveling hydraulic working machine has a target revolution speed of an engine commanded by an input and sensors for detecting an operating situation of a hydraulic actuator and an operating situation of a traveling system. A prime-mover revolution speed control modifies the target revolution speed of the prime mover when the operating situation of the hydraulic actuator and the operating situation of the traveling system come into respective particular states, and controls the revolution speed of the prime mover, With the traveling hydraulic working machine, in the combined operation of traveling and working a hydraulic actuator, work can be performed on the basis of the engine revolution speed intended by an operator. When a working load varies, the engine revolution speed is automatically controlled.

12 Claims, 10 Drawing Sheets

TRAVELING HYDRAULIC WORKING MACHINE

TECHNICAL FIELD

The present invention relates to a traveling hydraulic working machine, such as a telescopic handler, in which a traveling means, including a torque converter, and a hydraulic pump are coupled to a prime mover (engine) and a working actuator is operated by a hydraulic fluid supplied from the hydraulic pump while operating the traveling means, to thereby perform predetermined work.

BACKGROUND ART

The related art of that type of traveling hydraulic working machine is disclosed in JP,B 8-30427 and JP,B 8-30429.

In the related art disclosed in JP,B 8-30427, the engine revolution speed is full-automatically controlled through the steps of detecting the engine revolution speed, the output revolution speed of a torque converter, and the delivery pressure of a hydraulic pump, computing the status of a machine body based on the detected information, and then computing a final throttle command. A target traction force is thereby obtained so that a crawler slippage will not occur.

In the related art disclosed in JP,B 8-30429, a plurality of engine output modes are set beforehand, and one of the modes is selected by an operator depending on a load situation during work, to thereby obtain an engine output required in bulldozing work.

JP,B 8-30427

JP,B 8-30429

DISCLOSURE OF THE INVENTION

When a traveling hydraulic working machine, such as a telescopic handler, is operated to perform work with the combined operation of traveling and a working actuator, the load pressure of the working actuator (i.e., the working load) is greatly varied depending on the work situation. In some cases, therefore, the combination of the traveling and the working actuator becomes improper and the working efficiency is reduced.

For example, work for excavating natural ground is known as one kind of work that is performed with a bucket used as a front attachment. In the excavation work, the bucket as the front attachment is pushed to thrust into earth and sand (excavation target) by a travel force while the engine revolution speed is controlled by operating an accelerator pedal. Then, the earth and sand are excavated by applying a front force acting upward to the bucket in such a manner as to gradually displace the bucket upward. When the bucket is pushed to thrust into the earth and sand, heavy load work is performed in which the load pressure of the working actuator (i.e., the working load) rises and so does the delivery pressure of a hydraulic pump. After the bucket is moved upward subsequent to the thrusting of the bucket, the load pressure of the working actuator (i.e., the working load) lowers and light load work is performed. In a known general traveling hydraulic working machine, therefore, when the working load is changed from a heavy load to a light load as mentioned above, the engine revolution speed is increased, thus leading to a problem that the input torque of the torque converter is increased with the increase of the engine revolution speed, and the bucket overruns when it is moved upward.

As another kind of work, there is surface soil peeling-off work for peeling off earth and sand at the ground surface by a bucket to form a flat ground surface while the machine is traveled by operating an accelerator pedal. During such work, the load pressure of the work actuator (i.e., the working load) varies depending on the thickness and hardness of the earth and sand to be peeled off by the bucket. In the known general traveling hydraulic working machine, therefore, when the bucket strikes against a thick or hard portion of the earth and sand and the pump delivery pressure (i.e., the working load) rises during the surface soil peeling-off work, the engine revolution speed is just slightly increased and the traveling speed is hardly reduced. Consequently, the bucket cannot evenly peel off the thick or hard portion of the earth and sand, and a satisfactory flat excavation surface cannot be formed.

According to the related art disclosed in JP,B 8-30427 (Patent Reference 1), the delivery pressure of the hydraulic pump is detected as one item of the information for judging the status of the machine body. However, the detected pump delivery pressure is used to obtain the final throttle command by adding a modification value that corresponds to a pump absorption torque. In other words, the detected pump delivery pressure is not used to determine if the working load has changed to a particular state, and this related art cannot overcome the above-mentioned problem that is caused when the working load varies and comes into the particular state. Further, because the engine revolution speed is automatically controlled regardless of the revolution speed commanded from the accelerator pedal, an operator cannot perform work as per intended in the earth-and-sand excavating work and the surface soil peeling-off work.

In the related art disclosed in JP,B 8-30429 (Patent Reference 2), the working load is not detected and the engine control is performed only in one of the preset engine output modes. Therefore, this related art also cannot overcome the above-mentioned problem that is caused when the working load varies and comes into the particular state.

It is an object of the present invention to provide a traveling hydraulic working machine which can perform work on the basis of the engine revolution speed during the combined operation of traveling and a working actuator, and which can automatically control the engine revolution speed in response to a variation of the working load so that satisfactory combination can be kept in the combined operation of the traveling and the working actuator and efficient work can be realized.

(1) To achieve the above object, the present invention provides a traveling hydraulic working machine comprising at least one prime mover, a machine body for mounting the prime mover thereon, traveling means mounted on the machine body and including a torque converter coupled to the prime mover, a hydraulic pump driven by the prime mover, at least one working actuator operated by a hydraulic fluid supplied from the hydraulic pump, and an operating device for generating an operation signal to control the working actuator, wherein the traveling hydraulic working machine further comprises input means for commanding a target revolution speed of the prime mover; first detection means for detecting an operating situation of the working actuator; second detection means for detecting an operating situation of the traveling means; and prime-mover revolution speed control means for modifying the target revolution speed of the prime mover based on the operating situation of the working actuator detected by the first detection means and the operating situation of the traveling means detected by the second detection means, and controlling the revolution speed of the prime mover.

Thus, since the revolution speed of the prime mover is controlled by modifying the target revolution speed commanded from the input means, work can be performed on the basis of the engine revolution speed intended by the operator.

Also, the revolution speed of the prime mover is controlled by modifying the target revolution speed of the prime mover based on the operating situation of the working actuator and the operating situation of the traveling means. Accordingly, even when the working load varies in the combined operation of traveling and the working actuator, the engine revolution speed of the prime mover is automatically controlled so that satisfactory combination can be kept in the combined operation of the traveling and the working actuator and efficient work can be realized.

(2) In above (1), preferably, the first detection means includes means for detecting at least one of a delivery pressure of the hydraulic pump and a driving pressure of the working actuator.

With that feature, it is possible to detect the operating situation of the working actuator and to control the revolution speed when the working load varies.

(3) In above (2), preferably, the first detection means further includes means for detecting the operation signal generated from the operating device.

With that feature, the operating situation of the working actuator can be detected including the operating direction of the actuator, and the revolution speed control can be performed in a more appropriate manner.

(4) In above (1), preferably, the second detection means is means for detecting input and output revolution speeds of the torque converter, and the prime-mover revolution speed control means includes means for computing a torque converter speed ratio from input and output revolution speeds of the torque converter, and determining the operating situation of the traveling means.

With that feature, the operating situation of the traveling means can be determined based on the torque converter speed ratio, and the revolution speed control of the prime mover can be performed in an appropriate manner.

(5) In above (1), preferably, the prime-mover revolution speed control means includes means for computing a modification revolution speed of the prime mover when the operating situation of the working actuator detected by the first detection means and the operating situation of the traveling means detected by the second detection means come into respective particular states, and means for subtracting the modification revolution speed from the target revolution speed of the prime mover.

With that feature, the engine revolution speed is automatically controlled to reduce in response to a variation of the working load. Accordingly, in work requiring the engine revolution speed to be reduced when the working load varies, such as work for excavating natural ground and work for peeling off surface soil, satisfactory combination can be kept in the combined operation of the traveling and the working actuator and efficient work can be realized.

(6) In above (1), preferably, the prime-mover revolution speed control means includes means for modifying the target revolution speed of the prime mover to reduce when the operating situation of the traveling means is in a state close to a stall of the torque converter and the operating situation of the working actuator comes into a light load state.

With that feature, in work requiring the engine revolution speed to be reduced when the operating situation of the traveling means is in the state close to a stall of the torque converter and the working load is reduced, such as the natural ground excavating work, satisfactory combination can be kept in the combined operation of the traveling and the working actuator and efficient work can be realized.

(7) In above (1), preferably, the prime-mover revolution speed control means includes means for modifying the target revolution speed of the prime mover to reduce when the operating situation of the traveling means is in a state far from a stall of the torque converter and the operating situation of the working actuator comes into a heavy load state.

With that feature, in work requiring the engine revolution speed to be reduced when the operating situation of the traveling means is in the state far from a stall of the torque converter and the working load is increased, such as the surface soil peeling-off work, satisfactory combination can be kept in the combined operation of the traveling and the working actuator and efficient work can be realized.

(8) In above (1), preferably, the traveling hydraulic working machine further comprises third detection means for detecting an input amount from the input means, wherein the prime-mover revolution speed control means includes means for modifying the target revolution speed of the prime mover when the input amount detected by the third detection means is not smaller than a preset value.

With that feature, the prime-mover revolution speed control means is not activated when the engine revolution speed is in a low-speed range. Therefore, the revolution speed control of the prime mover can be performed in an appropriate manner only when required.

BEST MODE FOR CARRYING OUT THE INVENTION

Embodiments of the present invention will be described below.

Figure 1:
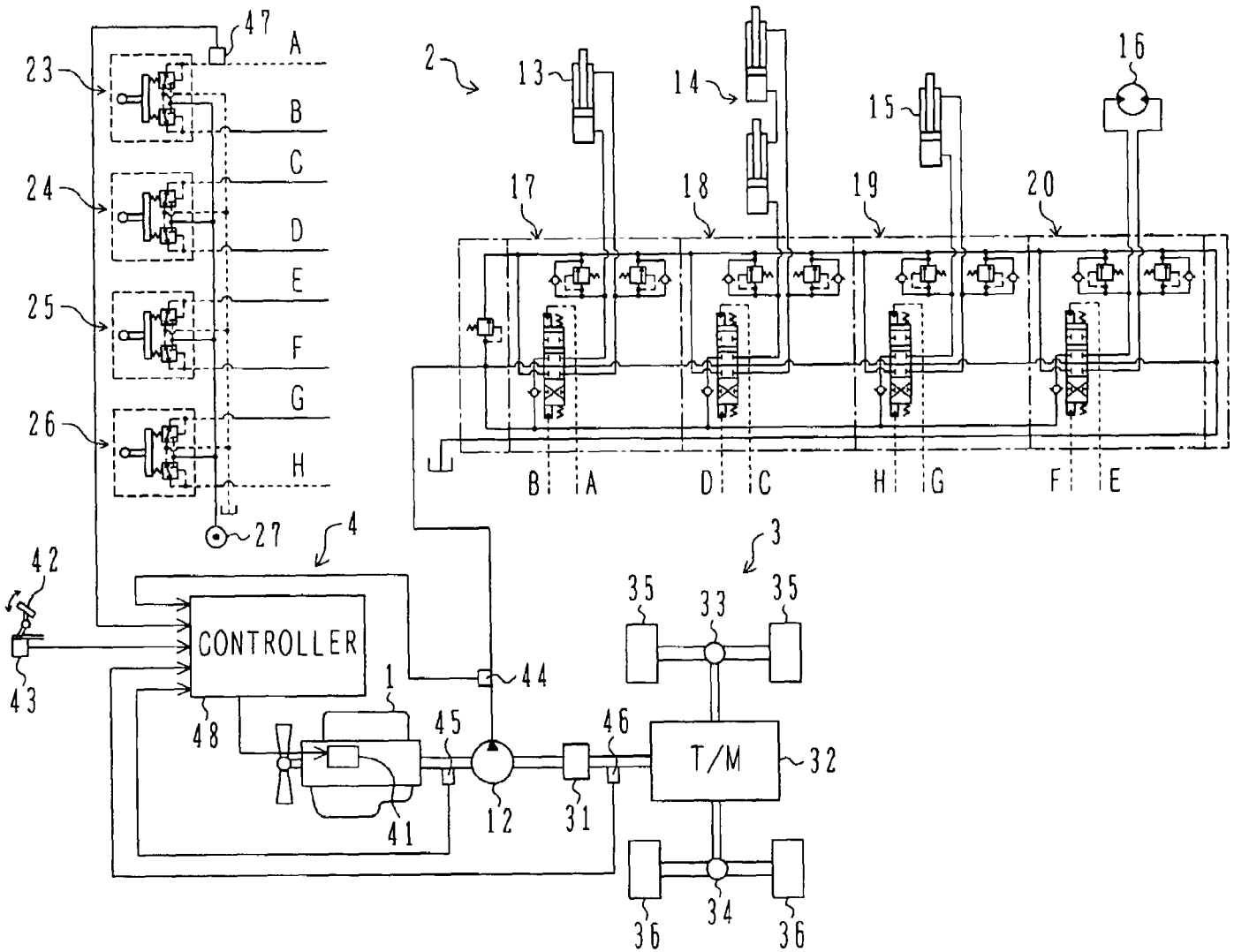
FIG. 1 is a circuit diagram showing an overall system of a traveling hydraulic working machine according to a first embodiment of the present invention.

FIG. 1 is a circuit diagram showing an overall system of a traveling hydraulic working machine according to a first embodiment of the present invention.

In FIG. 1, a traveling hydraulic working machine according to this embodiment comprises a diesel engine (hereinafter referred to simply as an "engine") 1 serving as a prime mover, a working system 2 and a traveling system 3 both driven by the engine 1, and a control system 4 for the engine 1.

The working system 2 comprises a hydraulic pump 12 driven by the engine 1, a plurality of hydraulic actuators (working actuators) 13, 14, 15 and 16 operated by a hydraulic fluid delivered from the hydraulic pump 12, directional control valves 17, 18, 19 and 20 disposed respectively between the hydraulic pump 12 and the plurality of hydraulic actuators (working actuators) 13, 14, 15 and 16, to thereby control flows of the hydraulic fluid supplied to the corresponding actuators, a plurality of control lever units 23, 24, 25 and 26 for shifting the directional control valves 17, 18, 19 and 20 and generating pilot pressures (operation signals), and a pilot hydraulic pump 27 for supplying the hydraulic fluid, which serves as an original pressure, to the control lever units 23, 24, 25 and 26.

The traveling system 3 comprises a torque converter 31 coupled to an output shaft of the engine 1 in series with respect to the hydraulic pump 12, a transmission (T/M) 32 coupled to an output shaft of the torque converter 31, and front wheels 35 and rear wheels 36 coupled to the transmission 32 respectively through differential gears 33, 34.

The engine control system 4 comprises an electronic governor 41 for adjusting a fuel injection amount in the engine 1, an accelerator pedal 42 operated by an operator and commanding a target engine revolution speed (hereinafter referred to simply as an "target revolution speed"), a position sensor 43 for detecting a tread amount by which the accelerator pedal 42 is operated (i.e., an accelerator tread amount), a pressure sensor 44 for detecting, as an operating situation of the hydraulic actuator, the delivery pressure of the hydraulic pump 12, a rotation sensor 45 for detecting an output revolution speed of the engine 1 (i.e., an input revolution speed of the torque converter 31), a rotation sensor 46 for detecting an output revolution speed of the torque converter 31, a pressure sensor 47 for detecting, as an operating situation of the hydraulic actuator, a pilot pressure in the extending direction of the hydraulic actuator 13 (i.e., a boom-raising pilot pressure) which is one of pilot pressures outputted from the control lever unit 23, and a controller 48 for executing predetermined arithmetic operations based on input signals from the position sensor 43, the pressure sensor 44, the rotation sensors 45, 46 and the pressure sensor 47, and outputting a command signal to the electronic governor 41.

Figure 2:
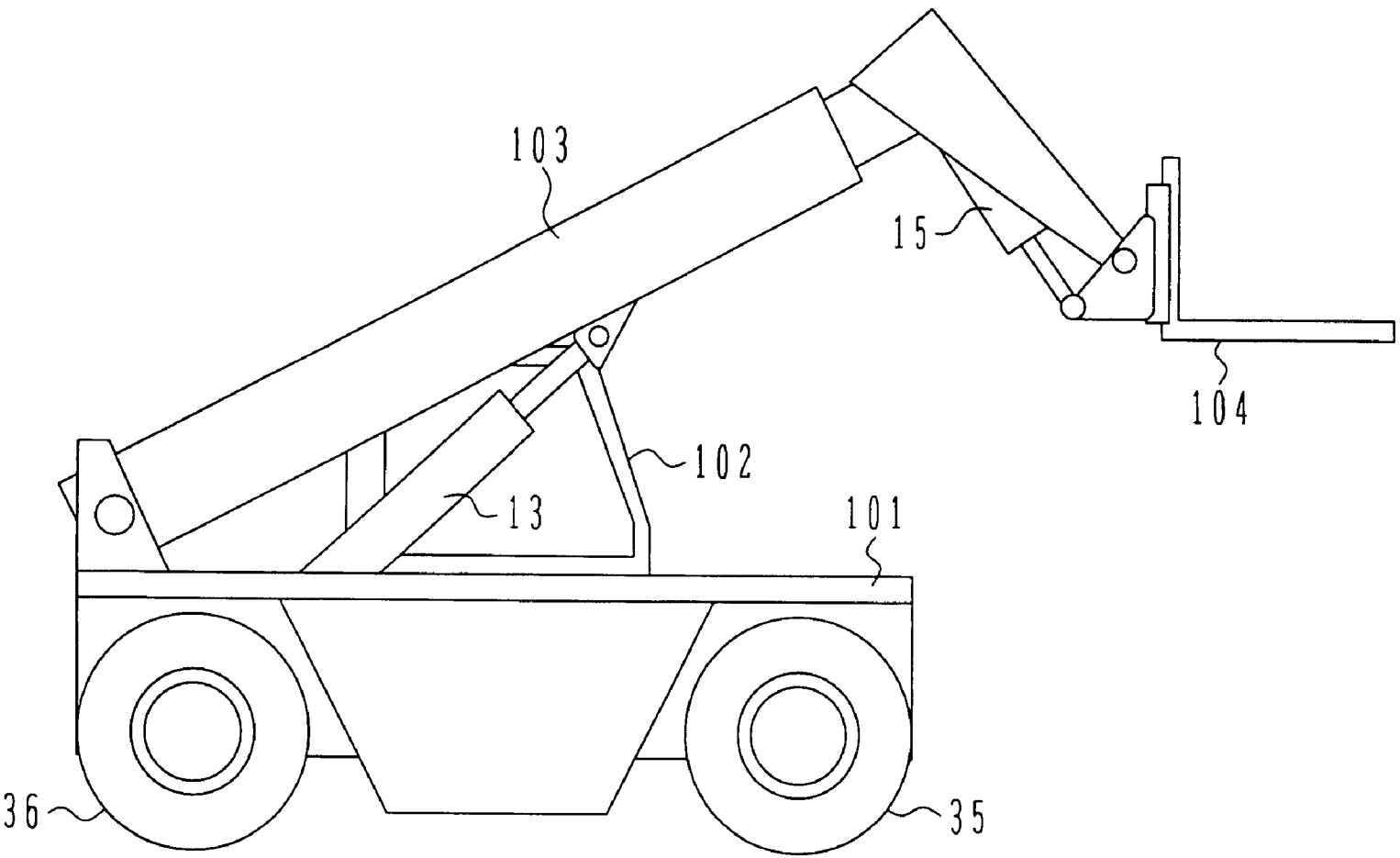
FIG. 2 is a side view showing an external appearance of a telescopic handler, the view showing the case where a fork for use in loading and unloading work is mounted as an attachment.
Figure 3:
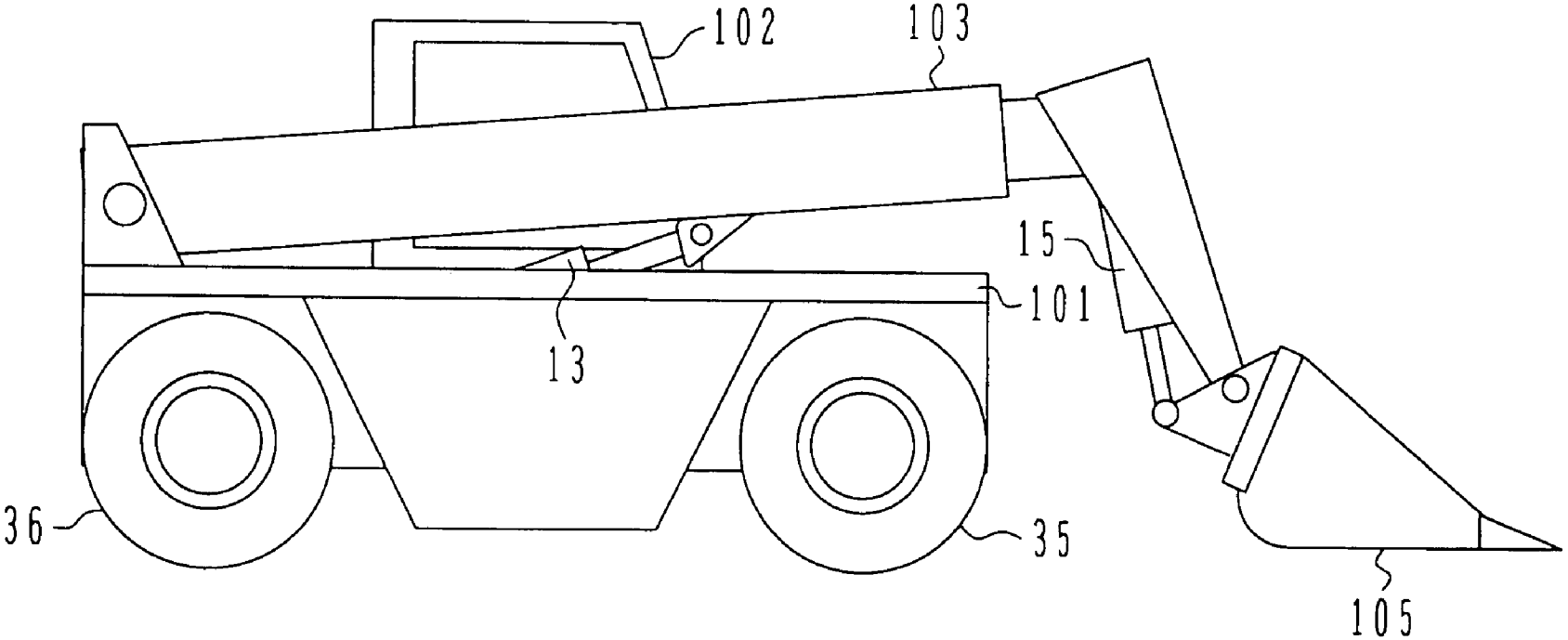
FIG. 3 is a side view showing an external appearance of a telescopic handler, the view showing the case where a bucket for use in excavation work and surface soil peeling-off work is mounted as an attachment.

FIGS. 2 and 3 each show an external appearance of a telescopic handler (also called a lift truck).

In this embodiment, the traveling hydraulic working machine is, by way of example, a telescopic handler. The telescopic handler comprises a machine body 101, a cab 102 located on the machine body 101, an extendable boom 103 mounted to the machine body 101 in a manner capable of pivotally rising and lowering laterally of the cab 102, and an attachment 104 or 105 rotatably mounted to a fore end of the boom 103. The front wheels 35 and the rear wheels 36 are mounted to the machine body 101, and the telescopic handler travels with the front wheels 35 and the rear wheels 36 driven by motive power of the engine 1. The boom 103 and the attachment 104 or 105 constitute a working device. The attachment 104 shown in FIG. 2 is a fork for use in loading and unloading work, and the attachment 105 shown in FIG. 3 is a bucket for use in, e.g., excavation work and surface soil peeling-off work.

Returning to FIG. 1, the hydraulic actuators 13, 14 and 15 are, by way of example, a boom cylinder, a telescopic cylinder, and an attachment cylinder, respectively. The boom 103 is pivotally raised or lowered with extension or contraction of the boom cylinder 13, and is extended or contracted with extension or contraction of the telescopic cylinder 14. The attachment 104 or 105 is tilted with extension or contraction of the attachment cylinder 15. The hydraulic actuator 16 shown in FIG. 1 is a hydraulic motor for rotating a sweeper brush, for example, when a sweeper is used as the front attachment. Those components, such as the engine 1, the hydraulic pump 12, the torque converter 31, and the transmission 32, are mounted to the machine body 101.

Figure 4:
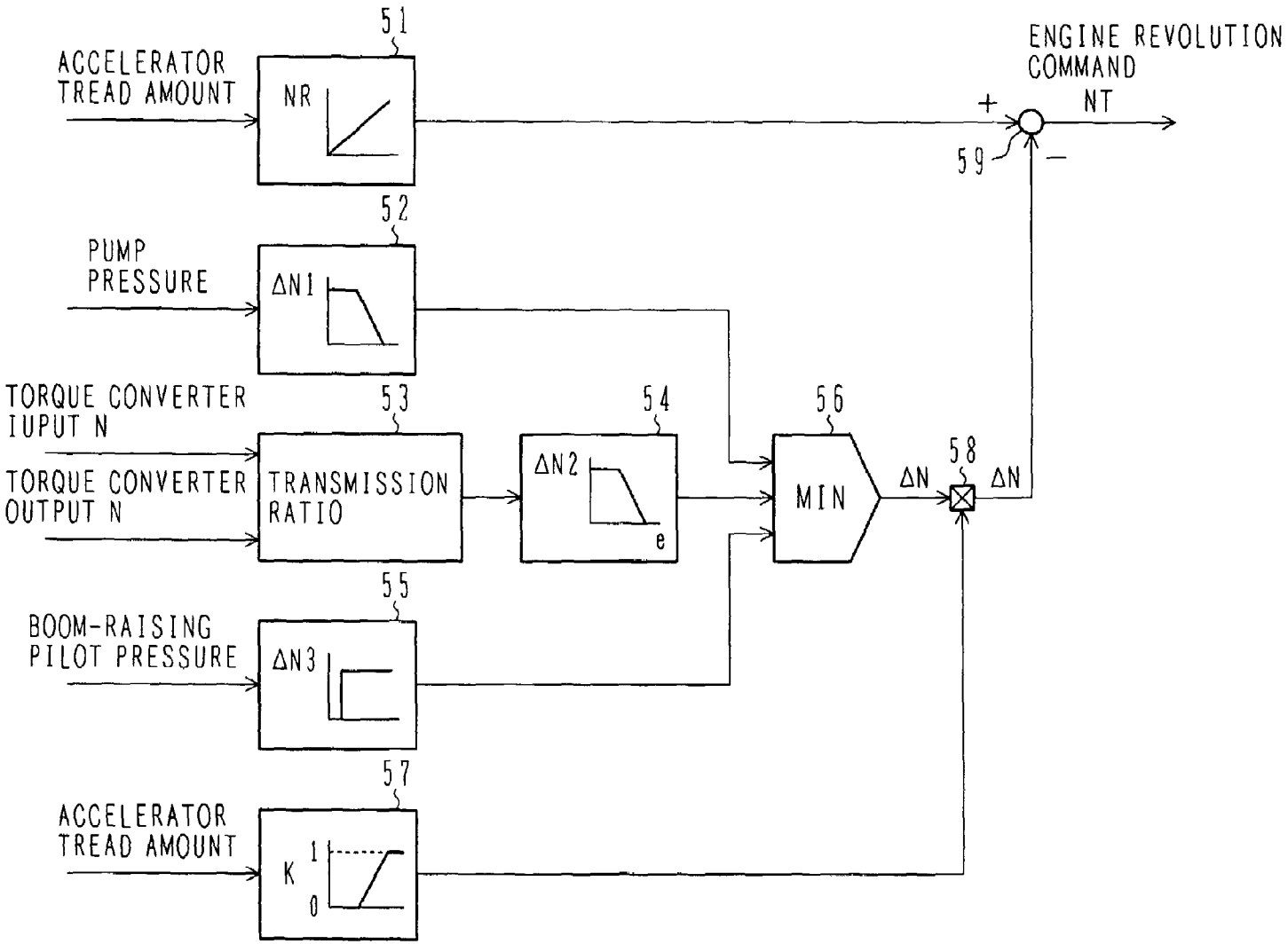
FIG. 4 is a functional block diagram showing the processing function of a controller in the first embodiment of the present invention.

FIG. 4 is a functional block diagram showing the processing function of the controller 48.

In FIG. 4, the controller 48 has various functions of a reference target revolution speed computing unit 51, a first modification revolution speed computing unit 52, a speed ratio computing unit 53, a second modification revolution speed computing unit 54, a third modification revolution speed computing unit 55, a minimum value selector 56, a modification effective/ineffective factor computing unit 57, a multiplier 58, and a subtractor 59.

The reference target revolution speed computing unit 51 receives a detected signal of the accelerator tread amount from the position sensor 43 and refers to a table, which is stored in a memory, based on the received signal, thereby computing a reference target revolution speed NR corresponding to the accelerator tread amount at that time. The reference target revolution speed NR represents the engine revolution speed intended by the operator during work. In the table stored in the memory, the relationship between the reference target revolution speed NR and the accelerator tread amount is set such that the reference target revolution speed NR is increased as the accelerator tread amount increases.

The first modification revolution speed computing unit 52 receives a detected signal of the pump pressure from the pressure sensor 44 and refers to a table, which is stored in a memory, based on the received signal, thereby computing a first modification revolution speed $\Delta N1$ corresponding to the pump pressure at that time. The first modification revolution speed $\Delta N1$ is to reduce the engine revolution speed when the delivery pressure of the hydraulic pump 12 is low (namely the working load is small), i.e., when the working system 2 is in a light load state. In the table stored in the memory, the relationship between the first modification revolution speed $\Delta N1$ and the pump pressure is set such that $\Delta N1=\Delta NA$ holds when the pump pressure is lower than a first setting value, ΔN1 is reduced as the pump pressure rises, and ΔN1=0 holds when the pump pressure exceeds a second setting value (>first setting value).

The speed ratio computing unit 53 receives detected signals of the input and output revolution speeds of the torque converter 31 from the revolution sensors 45, 46. Then, it executes arithmetic operation of e=output revolution speed/input revolution speed to compute a torque converter speed ratio e.

The second modification revolution speed computing unit 54 receives the torque converter speed ratio e computed by the speed ratio computing unit 53 and refers to a table, which is stored in a memory, based on the received signal, thereby computing a second modification revolution speed ΔN2 corresponding to the torque converter speed ratio e at that time. The second modification revolution speed ΔN2 is to reduce the engine revolution speed when the torque converter speed ratio e is small (namely the torque converter 31 is in a state close to a stall), i.e., when the traveling system 3 is in an operating situation requiring a traction force (travel force). In the table stored in the memory, the relationship between the second modification revolution speed ΔN2 and the torque converter speed ratio e is set such that ΔN2=ΔNB holds when the torque converter speed ratio e is smaller than a first setting value, ΔN2 is reduced as the torque converter speed ratio e increases, and ΔN2=0 holds when the torque converter speed ratio e exceeds a second setting value (>first setting value).

The third modification revolution speed computing unit 55 receives a detected signal of the boom-raising pilot pressure from the pressure sensor 47 and refers to a table, which is stored in a memory, based on the received signal, thereby computing a third modification revolution speed ΔN3 corresponding to the boom-raising pilot pressure at that time. The third modification revolution speed ΔN3 is to reduce the engine revolution speed when the boom raising operation is performed. In the table stored in the memory, the relationship between the third modification revolution speed ΔN3 and the boom-raising pilot pressure is set such that ΔN3=ΔNC holds when the boom-raising pilot pressure exceeds a setting value close to 0.

The minimum value selector 56 selects a minimum value among the first modification revolution speed ΔN1, the second modification revolution speed ΔN2, and the third modification revolution speed ΔN3, and sets the selected value as a modification revolution speed ΔN. Herein, by way of example, ΔNA in the first modification revolution speed computing unit 52, ΔNB in the second modification revolution speed computing unit 54, and ΔNC in the third modification revolution speed computing unit 55 are set to satisfy ΔNA=ΔNB=ΔNC. Then, when the first modification revolution speed computing unit 52, the second modification revolution speed computing unit 54, and the third modification revolution speed computing unit 55 compute ΔNA, ΔNB and ΔNC, respectively, the minimum value selector 56 selects minimum one of them, e.g., ΔNA, in accordance with the preset logic.

The modification effective/ineffective factor computing unit 57 receives the detected signal of the accelerator tread amount from the position sensor 43 and refers to a table, which is stored in a memory, based on the received signal, thereby computing a modification effective/ineffective factor K corresponding to the accelerator tread amount at that time. The modification effective/ineffective factor K is used not to reduce the engine revolution speed when the target revolution speed intended by the operator during work is in a low-speed range and a reduction of the engine revolution speed is not required (namely, the factor K is used to reduce the engine revolution speed only when the target revolution speed is in a medium- or high-speed range). In the table stored in the memory, the relationship between the modification effective/ineffective factor K and the accelerator tread amount is set such that K=0 holds when the accelerator tread amount is smaller than a first setting value, K is increased as the accelerator tread amount increases from the first setting value, and K=1 holds when the accelerator tread amount exceeds a second setting value (>first setting value). The reason why K is set to increase as the accelerator tread amount increases from the first setting value resides in making it possible to reduce the engine revolution speed in a corresponding way when the target revolution speed is in the medium-speed range. If that function is not required, the above relationship may be set in an ON/OFF-like manner such that K=0 holds when the accelerator tread amount is smaller than the second setting value or a nearby value, and K=1 holds when the accelerator tread amount exceeds the second setting value or the nearby value. This setting makes it possible to reduce the engine revolution speed only when the target revolution speed is in the high-speed range.

The multiplier 58 multiplies the modification revolution speed ΔN selected by the minimum value selector 56 by the factor K computed by the modification effective/ineffective factor computing unit 57 to obtain a final modification revolution speed ΔN.

The subtractor 59 subtracts the modification revolution speed ΔN computed by the multiplier 58 from the reference target revolution speed NR computed by the reference target revolution speed computing unit 51 to obtain a target revolution speed NT for engine control. The target revolution speed NT is converted to a target fuel injection amount in a known manner, which is outputted as a command signal to the electronic governor 41.

In the arrangement described above, the accelerator pedal 42 and the position sensor 43 constitute input means for commanding the target revolution speed of the engine 1 serving as the prime mover. The pressure sensors 44, 47 constitute first detection means for detecting the operating situation of the hydraulic actuator 13, etc. serving as the working actuators. The rotation sensors 45, 46 constitute second detection means for detecting the operating situation of traveling means. The various functions of the reference target revolution speed computing unit 51, the first modification revolution speed computing unit 52, the speed ratio computing unit 53, the second modification revolution speed computing unit 54, the third modification revolution speed computing unit 55, the minimum value selector 56, and the subtractor 59 in the controller 48 constitute prime-mover revolution speed control means for modifying the target revolution speed of the prime mover 1 based on the operating situation of the hydraulic actuator 13, etc. detected by the first detection means 44, 47 and the operating situation of the traveling means detected by the second detection means 45, 46, and controlling the revolution speed of the prime mover.

The operation of this embodiment will be described below.

Figure 5:
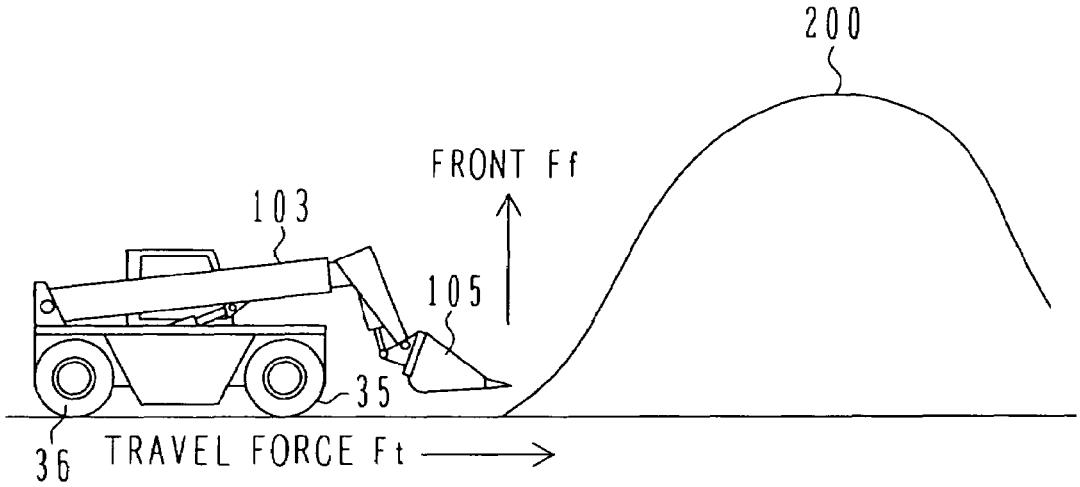
FIG. 5 illustrates excavation work performed by the telescopic handler.
Figure 6:
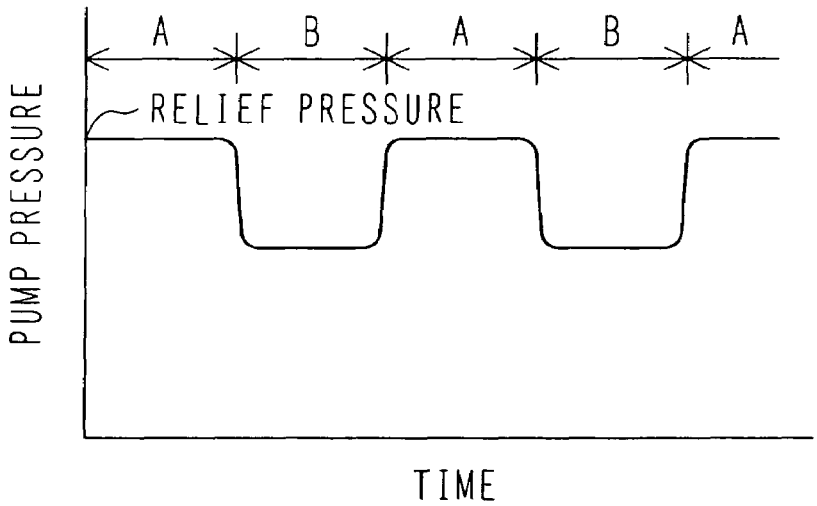
FIG. 6 is a chart showing changes in pump pressure during the excavation work.

FIG. 5 illustrates how work for excavating natural ground is performed by the telescopic handler with the bucket 105 mounted as the attachment. FIG. 6 is a chart showing changes in the delivery pressure of the hydraulic pump 12 (i.e., the pump pressure) during the excavation work.

In the natural ground excavating work, the accelerator pedal 42 (FIG. 1) is operated to set the revolution speed of the engine 1 to a desired value, while the bucket 105 is pushed to thrust into earth and sand 200 of the natural ground by a travel force Ft outputted from the engine 1 through the torque converter 31. Then, the earth and sand are excavated by operating the boom cylinder 13 and the attachment cylinder 15 (FIG. 1) to raise the boom 103 and tilt the bucket 105, respectively, thereby giving the bucket 105 with an upward front force Ff such that the bucket 105 is gradually displaced upward. In that work, when the bucket 105 is pushed to thrust into the earth and sand, the load pressure of the boom cylinder 13 and/or the attachment cylinder 15 serving as the working actuators (i.e., the working load) rises and so does the delivery pressure of the hydraulic pump 12 (*Fig.* 1) (heavy load work; zone A in FIG. 6). After the bucket 105 is moved upward subsequent to the thrusting of the bucket 105, the load pressure of the working actuators 13, 15 (i.e., the working load) lowers and so does the pump pressure (light load work; zone B in FIG. 6).

Figure 7:
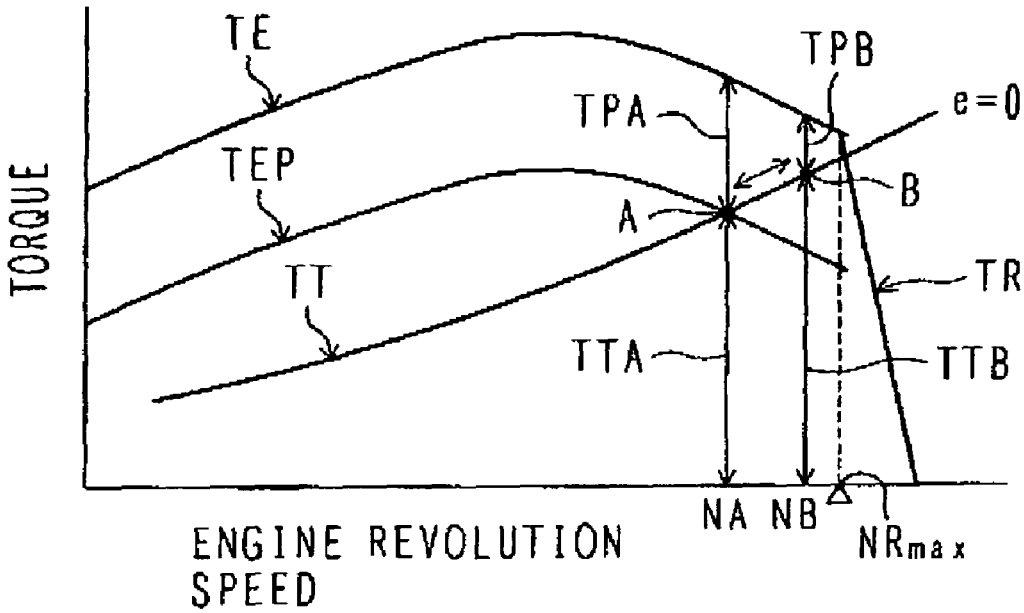
FIG. 7 PRIOR ART
FIG. 7 is a graph showing the relationship among engine output torque, pump absorption torque, and torque converter input torque in a known general traveling hydraulic working machine, the graph also showing the operation state of a traveling system in excavation work.

FIG. 7 is a graph showing the relationship among engine output torque, pump absorption torque, and torque converter input torque in a known general traveling hydraulic working machine, the graph also showing the operation state in the excavation work, shown in FIGS. 5 and 6, on condition that the target revolution speed (reference target revolution speed NR in FIG. 4) commanded from the accelerator pedal is set to a maximum (rated) value NRmax. In FIG. 7, TE represents a characteristic of the engine output torque in a full load region where the fuel injection amount of the electronic governor 41 is maximized. TR represents a characteristic of the engine output torque in a regulation region before the fuel injection amount of the electronic governor 41 is maximized. TPA represents the pump absorption torque (maximum pump absorption torque) in, e.g., a combined stall state where the hydraulic pump 12 consumes a maximum absorption torque. TEP represents a characteristic of the torque converter input torque resulting by subtracting TPA from TE, when the hydraulic pump 12 consumes the maximum absorption torque. TT represents a characteristic of the torque converter input torque in a full load region when the torque converter 31 is in a stall state. The stall state of the torque converter 31 means the state where the output revolution speed is 0, i.e., the state of the speed ratio e =0. Also, the term "combined stall state"means the state where the torque converter 31 is in the stall state (e =0), and the delivery pressure of the hydraulic pump 12 rises to the setting pressure of a main relief valve (not shown) and is in a relief state.

In the excavation work shown in FIGS. 5 and 6, the operation state in the zone A, in which the bucket is pushed to thrust into the earth and sand, corresponds to a point A in FIG. 7, and the operation state in the zone B, in which the bucket is moved upward after the thrusting of the bucket, corresponds to a point B in FIG. 7.

In the excavation work shown in FIGS. 5 and 6, the traveling speed of the telescopic handler is near 0 and the torque converter 31 is substantially in the stall state (e=0). Also, in the thrusting operation of the bucket, the pump pressure rises to the relief pressure and the pump absorption torque is maximized to TPA, thus resulting in the combined stall state (heavy load state) (point A). When the bucket 105 is moved upward after the thrusting of the bucket, the pump pressure lowers and the pump absorption torque is reduced from TPA to TPB, thus resulting in a light load state (point B). As a consequence, the operating point of the traveling system shifts from the point A to B, and the actual engine revolution speed is increased from NA at the point A to NB at the point B.

Thus, the known general traveling hydraulic working machine has the problem that when the working load is changed from a heavy load to a light load, the actual engine revolution speed is increased from NA to NB and, with this increase of the engine revolution speed, the input torque of the torque converter 31 is increased from TTA to TTB, which results in excessive thrusting of the bucket 105.

Figure 8:
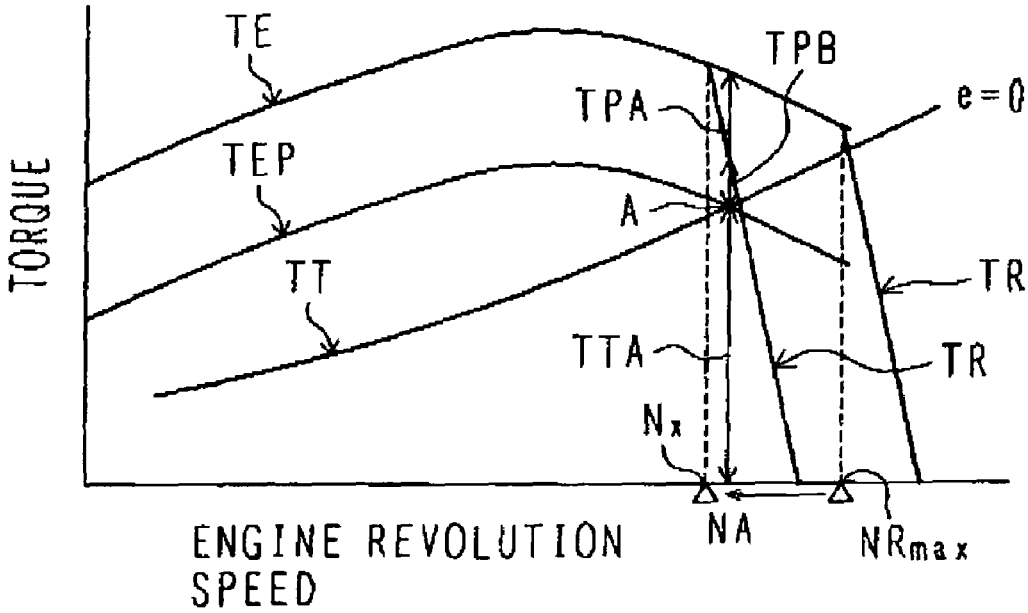
FIG. 8 is a graph showing the relationship among engine output torque, pump absorption torque, and torque converter input torque in the first embodiment of the present invention, the graph also showing the operation state of a traveling system in excavation work.

FIG. 8 is a graph showing the relationship among engine output torque, pump absorption torque, and torque converter input torque in this embodiment, the graph also showing the operation state in the excavation work, shown in FIG. 5, on condition that the target revolution speed (reference target revolution speed NR in FIG. 4) commanded from the accelerator pedal 42 is set to a maximum (rated) value NRmax.

According to this embodiment, in the excavation work shown in FIGS. 5 and 6, the controller 48 executes the processing, described below, for control of the engine revolution speed in the thrusting operation of the bucket.

First, the reference target revolution speed computing unit 51 computes, as the reference target revolution speed, the maximum target revolution speed NRmax based on the accelerator tread amount inputted through the accelerator pedal 42.

In the thrusting operation of the bucket, the pump pressure rises to the relief pressure (heavy load work; zone A in FIG. 6), and the first modification revolution speed computing unit 52 computes $\Delta N1=0$.

Also, in the excavation work, the torque converter 31 is in the state close to a stall where its output revolution speed is 0, and the speed ratio computing unit 53 computes $e\approx 0$. Therefore, the second modification revolution speed computing unit 54 computes $\Delta N2=\Delta NB$.

Further, in the thrusting operation of the bucket, the third modification revolution speed computing unit 55 computes $\Delta N3=0$ when the boom raising operation is not performed, and it computes $\Delta N3=\Delta NC$ when the boom raising operation is performed.

Accordingly, the minimum value selector 56 selects $\Delta N=0$.

On the other hand, since the accelerator pedal 42 is in the operated state to command the maximum target revolution speed NRmax, the modification effective/ineffective factor computing unit 57 computes K=1, and the multiplier 58 computes $\Delta N=0\times 1=0$.

As a result, the subtractor 59 computes NT=NRmax−0=NRmax. In other words, the target revolution speed NRmax commanded from the accelerator pedal 42 is used, as it is, as the target revolution speed for control, and the engine revolution speed is controlled in the same manner as in the related art. Thus, in FIG. 8, the traveling system 3 operates at the same point A as in the related art, and the actual engine revolution speed is NA.

When the bucket is moved upward after the thrusting of the bucket, the controller 48 executes the processing, described below, for the engine revolution speed control.

First, the reference target revolution speed computing unit 51 computes, as the reference target revolution speed, the maximum target revolution speed NRmax as in the thrusting operation of the bucket.

When the bucket is moved upward after the thrusting of the bucket, the pump pressure lowers (light load work; zone B in FIG. 6), and the first modification revolution speed computing unit 52 computes $\Delta N1=\Delta NA$.

Also, when the bucket is moved upward after the thrusting of the bucket, the torque converter 31 is in the state close to a stall where its output revolution speed is 0. Therefore, the speed ratio computing unit 53 computes $e\approx 0$, and the second modification revolution speed computing unit 54 computes $\Delta N2=\Delta NB$.

Further, when the bucket is moved upward after the thrusting of the bucket, the third modification revolution speed computing unit 55 computes $\Delta N3=\Delta NC$ when the boom cylinder 13 is extended to perform the boom raising operation.

Accordingly, the minimum value selector 56 selects ΔN=MIN(ΔNA, ΔNB, ΔNC), e.g., ΔN=ΔNA.

On the other hand, since the accelerator pedal 42 is in the stated operated to command the maximum target revolution speed NRmax, the modification effective/ineffective factor computing unit 57 computes K=1, and the multiplier 58 computes ΔN=ΔNA×1=ΔNA.

As a result, the subtractor 59 computes NT =NRmax−ΔNA. In other words, the target revolution speed for control is reduced by ΔNA from the revolution speed set by the accelerator pedal 42, and the engine control is performed based on that target revolution speed.

In FIG. 8, Nx represents the reduced target revolution speed (NT=NRmax−ΔNA). Thus, in this embodiment, since the target revolution speed is reduced when the bucket is moved upward after the thrusting of the bucket, the actual engine revolution speed is hardly changed from that in the thrusting operation of the bucket in spite of lowering of the pump pressure (working load), whereby the engine revolution speed is held substantially at the same value as that in the thrusting operation of the bucket, i.e., a value near the point A. Consequently, it is possible to prevent the excessive thrusting of the bucket 105 that has occurred in the related art. In addition, the engine revolution speed is reduced and therefore fuel economy is improved.

According to this embodiment, as described above, in the work for excavating natural ground with the combined operation of the traveling and the working actuator, the work can be performed on the basis of the engine revolution speed intended by the operator. Also, when the working load reduces, the engine revolution speed is automatically reduced so as to keep satisfactory combination in the combined operation of the traveling and the working actuator and to realize efficient work. In addition, since the engine revolution speed is reduced, fuel economy can be improved.

Further, according to this embodiment, because of detecting not only the pump pressure, but also the boom-raising pilot pressure as the operating situation of the hydraulic actuator 13, the excavation work can be detected in an accurate way.

Moreover, since the modification effective/ineffective factor computing unit 57 is provided so as not to execute the control for reducing the engine revolution speed when the engine revolution speed is in the low-speed range, an undesired reduction of the engine revolution speed can be avoided.

A second embodiment of the present invention will be described with reference to FIGS. 9 through 14. In this embodiment, the surface soil peeling-off work is performed using the telescopic handler.

Figure 9:
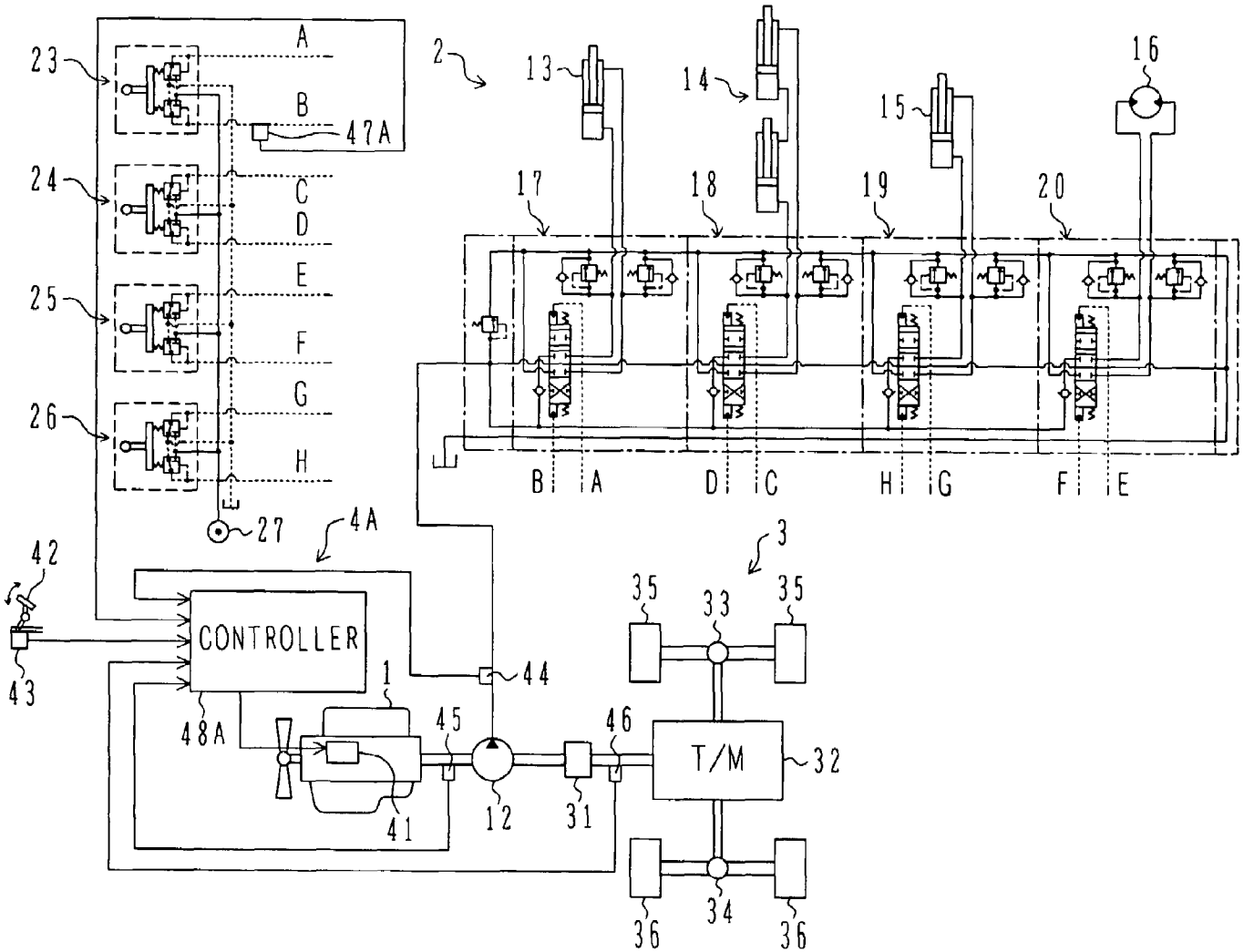
FIG. 9 is a circuit diagram showing an overall system of a traveling hydraulic working machine according to a second embodiment of the present invention.

FIG. 9 is a circuit diagram showing an overall system of a traveling hydraulic working machine according to this embodiment. In this embodiment, as means disposed in an engine control system 4A for detecting the operating situation of the hydraulic actuator, a pressure sensor 47A for detecting a boom-lowering pilot pressure outputted from the control lever unit 23 is disposed instead of the pressure sensor disposed in the first embodiment for detecting the boom-raising pilot pressure outputted from the control lever unit 23. A controller 48A executes predetermined arithmetic operations based on input signals from the pressure sensor 47A, the position sensor 43, the pressure sensor 44, and the rotation sensors 45, 46, and outputs a command signal to the electronic governor 41. The other arrangement of the overall system is the same as that in the first embodiment.

Figure 10:
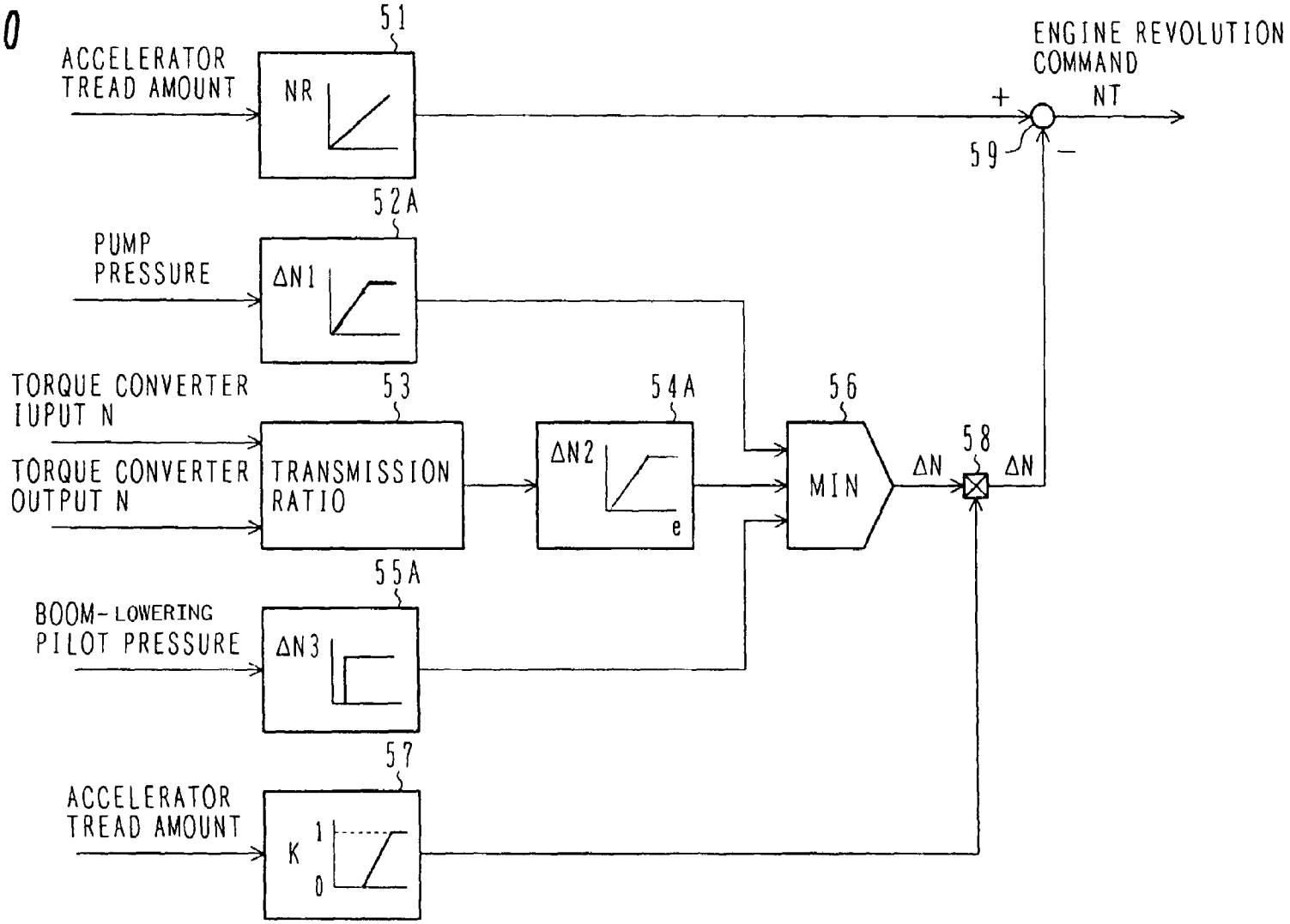
FIG. 10 is a functional block diagram showing the processing function of a controller in the second embodiment of the present invention.

FIG. 10 is a functional block diagram showing the processing function of the controller 48A in this embodiment. In FIG. 10, components having the same functions as those in FIG. 4 are denoted by the same symbols.

In FIG. 10, the controller 48A in this embodiment has various functions of a reference target revolution speed computing unit 51, a first modification revolution speed computing unit 52A, a speed ratio computing unit 53, a second modification revolution speed computing unit 54A, a third modification revolution speed computing unit 55A, a minimum value selector 56, a modification effective/ineffective factor computing unit 57, a multiplier 58, and a subtractor 59.

The first modification revolution speed computing unit 52A receives a detected signal of the pump pressure from the pressure sensor 44 and refers to a table, which is stored in a memory, based on the received signal, thereby computing a first modification revolution speed ΔN1 corresponding to the pump pressure at that time. The first modification revolution speed ΔN1 is to reduce the engine revolution speed when the delivery pressure of the hydraulic pump 12 is high (namely the working load is large), i.e., when the working system 2 is in a heavy load state. In the table stored in the memory, the relationship between the first modification revolution speed ΔN1 and the pump pressure is set such that ΔN1=0 holds when the pump pressure is lower than a first setting value, ΔN1 is increased as the pump pressure rises, and ΔN1=ΔNA holds when the pump pressure exceeds a second setting value (>first setting value).

The second modification revolution speed computing unit 54A receives a torque converter speed ratio e computed by the speed ratio computing unit 53 and refers to a table, which is stored in a memory, based on the received signal, thereby computing a second modification revolution speed ΔN2 corresponding to the torque converter speed ratio e at that time. The second modification revolution speed ΔN2 is to reduce the engine revolution speed when the torque converter speed ratio e is large (namely the torque converter 31 is in a state far from a stall), i.e., when the traveling system 3 is in an operating situation not requiring a traction force (travel force). In the table stored in the memory, the relationship between the second modification revolution speed ΔN2 and the torque converter speed ratio e is set such that ΔN2=0 holds when the torque converter speed ratio e is smaller than a first setting value, ΔN2 is increased as the torque converter speed ratio e increases, and ΔN2=ΔNB holds when the torque converter speed ratio e exceeds a second setting value (>first setting value).

The third modification revolution speed computing unit 55A receives a detected signal of the boom-lowering pilot pressure from the pressure sensor 47A, and refers to a table, which is stored in a memory, based on the received signal, thereby computing a third modification revolution speed ΔN3 corresponding to the boom-lowering pilot pressure at that time. The third modification revolution speed ΔN3 is to reduce the engine revolution speed when the boom lowering operation is performed. In the table stored in the memory, the relationship between the third modification revolution speed ΔN3 and the boom-lowering pilot pressure is set such that ΔN3 =ΔNC holds when the boom-lowering pilot pressure exceeds a value close to 0.

The other functions, i.e., the functions of the reference target revolution speed computing unit 51, the speed ratio computing unit 53, the minimum value selector 56, the modification effective/ineffective factor computing unit 57, the multiplier 58, and the subtractor 59 are the same as those in the first embodiment. More specifically, the minimum value selector 56 selects a minimum value among the first modification revolution speed ΔN1, the second modification revolution speed ΔN2, and the third modification revolution speed ΔN3, and sets the selected value as a modification revolution speed ΔN. The multiplier 58 multiplies the modification revolution speed ΔN selected by the minimum value selector 56 by a factor K computed by the modification effective/ineffective factor computing unit 57 to obtain a final modification revolution speed ΔN. The subtractor 59 subtracts the modification revolution speed ΔN computed by the multiplier 58 from the reference target revolution speed NR computed by the reference target revolution speed computing unit 51 to obtain a target revolution speed NT for engine control. The target revolution speed NT is converted to a target fuel injection amount in a known manner, which is outputted as a command signal to the electronic governor 41.

The operation of this embodiment will be described below.

Figure 11:
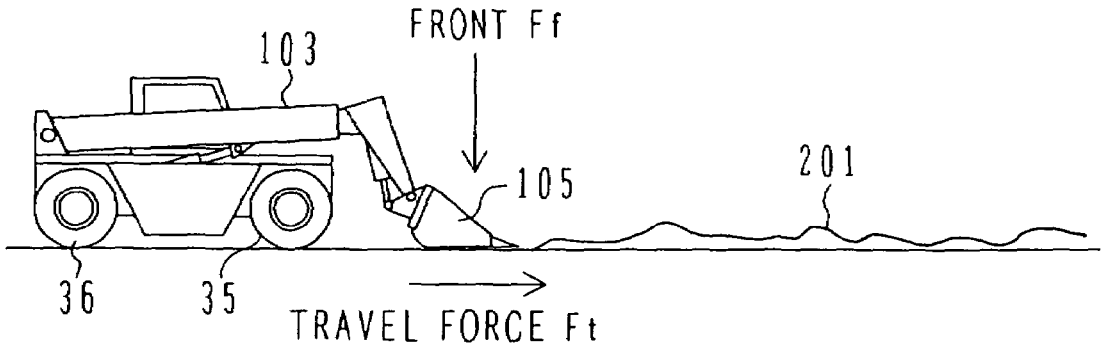
FIG. 11 illustrates the surface soil peeling-off work performed by the telescopic handler.
Figure 12:
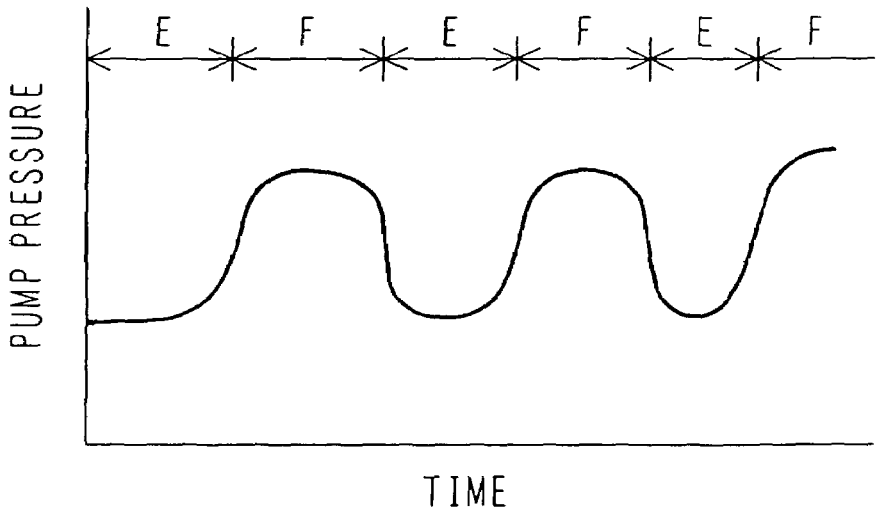
FIG. 12 is a chart showing changes in pump pressure during the surface soil peeling-off work.

FIG. 11 illustrates how the surface soil peeling-off work is performed by the telescopic handler with the bucket 105 mounted as the attachment. Also in the surface soil peeling-off work, the bucket 105 is mounted as the attachment. FIG. 12 is a chart showing changes in the delivery pressure of the hydraulic pump 12 (i.e., the pump pressure) during the surface soil peeling-off work.

In the surface soil peeling-off work, the accelerator pedal 42 (FIG. 1) is operated for traveling at a desired engine revolution speed, while the boom cylinder 13 and the attachment cylinder 15 (FIG. 1) are operated to lower the boom and tilt the bucket, respectively, thereby applying a downward front force Ff to the bucket 105 to be pressed against the ground such that the bucket 105 peels off rugged earth and sand 201 at the ground surface to form a flat ground surface. In that work, the load pressure of the boom cylinder 13 and the attachment cylinder 15 (i.e., the working load) is changed depending on the thickness and hardness of the surface earth and sand 201 to be peeled off by the bucket. More specifically, when the earth and sand have a thin thickness or are soft, the load pressure of the boom cylinder 13 and/or the attachment cylinder 15 (i.e., the working load) lowers (light load work; zone E in FIG. 12). When the bucket 105 strikes against a thick or hard portion of the earth and sand, the load pressure of the boom cylinder 13 and/or the attachment cylinder 15 (i.e., the working load) rises (heavy load work; zone F in FIG. 12).

Figure 13:
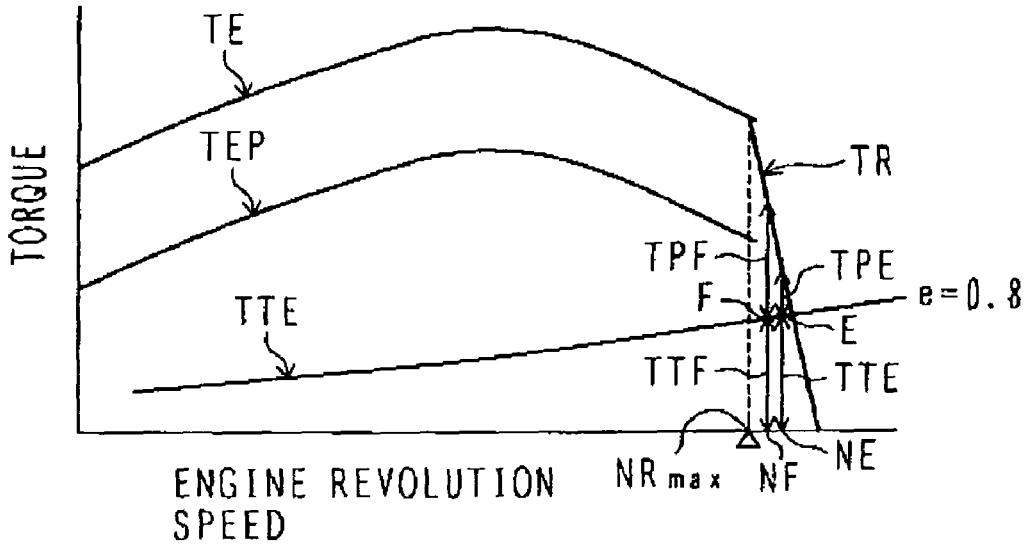
FIG. 13 PRIOR ART
FIG. 13 is a graph showing the relationship among engine output torque, pump absorption torque, and torque converter input torque in the known general traveling hydraulic working machine, the graph also showing the operation state of the traveling system in the surface soil peeling-off work.

FIG. 13 is a graph showing the relationship among engine output torque, pump absorption torque, and torque converter input torque in the known general traveling hydraulic working machine, the graph also showing the operation state in the surface soil peeling-off work, shown in FIGS. 11 and 12, on condition that the target revolution speed (reference target revolution speed NR in FIG. 10) commanded from the accelerator pedal is set to a maximum (rated) value NRmax. In FIG. 13, TE, TR and TEP represent the same characteristics as those described above in connection with FIG. 7. TTE represents a characteristic of the torque converter input torque when the torque converter 31 is in a travel state (i.e., a state far from a stall (e=0). The characteristic at e=0.8 is shown as one example.

In the surface soil peeling-off work shown in FIGS. 11 and 12, the operation state in the zone E, in which the earth and sand have a thin thickness or are soft, corresponds to a point E in FIG. 13, and the operation state in the zone F, in which the bucket 105 strikes against a thick or hard portion of the earth and sand, corresponds to a point F in FIG. 12.

In the surface soil peeling-off work shown in FIGS. 11 and 12, because the telescopic handler performs work while traveling, the output revolution speed of the torque converter 31 is relatively higher and the speed ratio is, for example, near e=0.8. Also, when the earth and sand to be peeled off have a thin thickness or are soft, the pump pressure is low and the pump absorption torque is small at a level of, e.g., about TPE as shown (point E). When the bucket 105 strikes against a thick or hard portion of the earth and sand, the pump pressure rises and the pump absorption torque is increased from TPE to TPF (point F). As a consequence, the operating point of the traveling system shifts from the point E to F, and the actual engine revolution speed is slightly reduced from NE at the point E to EF at the point F.

Thus, in the known general traveling hydraulic working machine, when the bucket strikes against a thick or hard portion of the earth and sand during the surface soil peeling-off work and the pump pressure (working load) rises, the actual engine revolution speed is just slightly reduced from NE to EF, and the traveling speed is hardly reduced. Therefore, the bucket 105 is moved at a high speed in spite of the earth and sand being thick or hard, and peels off the earth and sand in a forcible way, whereby a satisfactory flat excavation surface cannot be formed.

Figure 14:
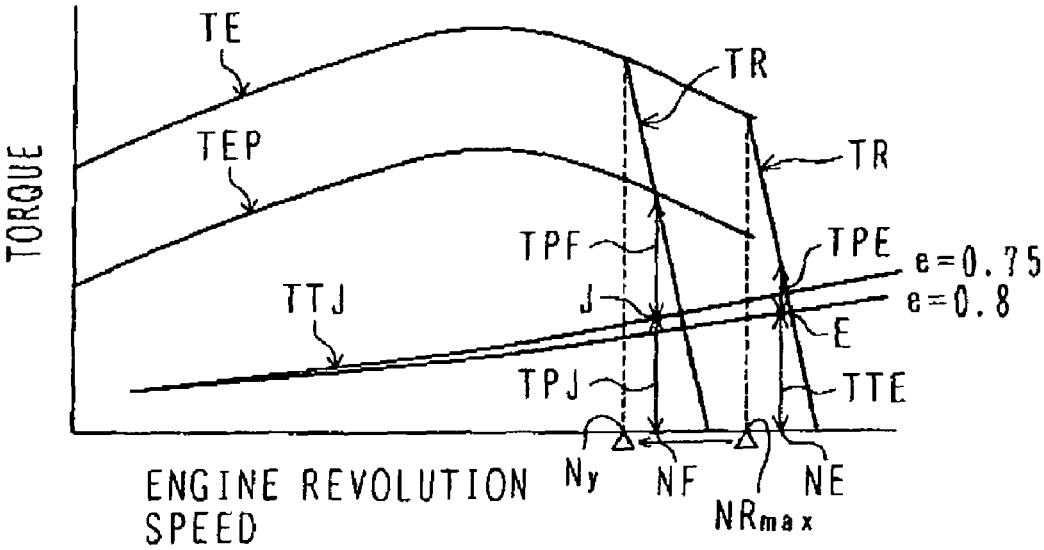
FIG. 14 is a graph showing the relationship among engine output torque, pump absorption torque, and torque converter input torque in the second embodiment of the present invention, the graph also showing the operation state of the traveling system in the surface soil peeling-off work.

FIG. 14 is a graph showing the relationship among engine output torque, pump absorption torque, and torque converter input torque in this embodiment, the graph also showing the operation state in the surface soil peeling-off work, shown in FIGS. 11 and 12, on condition that the target revolution speed (reference target revolution speed NR in FIG. 10) commanded from the accelerator pedal 42 is set to a maximum (rated) value NRmax.

According to this embodiment, in the surface soil peeling-off work shown in FIGS. 11 and 12, the controller 48A executes the processing, described below, for control of the engine revolution speed when the earth and sand have a thin thickness or are soft.

First, the reference target revolution speed computing unit 51 computes, as the reference target revolution speed, the maximum target revolution speed NRmax based on the accelerator tread amount inputted through the accelerator pedal 42.

When the earth and sand to be peeled off have a thin thickness or are soft, the pump pressure lowers (light load work; zone E in FIG. 12), and the first modification revolution speed computing unit 52A computes ΔN1=0.

Also, in the surface soil peeling-off work, the output revolution speed of the torque converter 31 is relatively higher (far from the stall state). Therefore, the speed ratio computing unit 53 computes e=0.8, for example, as the speed ratio, and the second modification revolution speed computing unit 54A computes ΔN2=ΔNB.

Further, because the boom lowering operation is performed in the surface soil peeling-off work, the third modification revolution speed computing unit 55A computes ΔN3=ΔNC.

Accordingly, the minimum value selector 56 selects ΔN=0.

On the other hand, since the accelerator pedal 42 is in the operated state to command the maximum target revolution speed NRmax, the modification effective/ineffective factor computing unit 57 computes K=1, and the multiplier 58 computes ΔN=0×1=0.

As a result, the subtractor 59 computes NT=NRmax−0=NRmax. In other words, the target revolution speed NRmax commanded from the accelerator pedal 42 is used, as it is, as the target revolution speed for control, and the engine revolution speed is controlled in the same manner as in the related art. Thus, in FIG. 14, the traveling system 3 operates at the same point E as in the related art, and the actual engine revolution speed is NE.

When the bucket 105 strikes against a thick or hard portion of the earth and sand, the controller 48A executes the processing, described below, for the engine revolution speed control.

First, the reference target revolution speed computing unit 51 computes, as the reference target revolution speed, the maximum target revolution speed NRmax as when the earth and sand to be peeled off have a thin thickness or are soft.

When the bucket 105 strikes against a thick or hard portion of the earth and sand, the pump pressure rises (heavy load work; zone F in FIG. 12), and the first modification revolution speed computing unit 52A computes ΔN1=ΔNA.

Also, in the surface soil peeling-off work, even when the bucket 105 strikes against a thick or hard portion of the earth and sand, the telescopic handler continues traveling and the torque converter 31 is in the state far from a stall. Therefore, the speed ratio computing unit 53 computes e=0.75 as the speed ratio, and the second modification revolution speed computing unit 54A computes ΔN2=ΔNB.

Further, because the boom lowering operation is performed in the surface soil peeling-off work, the third modification revolution speed computing unit 55A computes ΔN3=ΔNC.

Accordingly, the minimum value selector 56 selects ΔN=MIN(ΔNA, ΔNB, ΔNC), e.g., ΔN=ΔNA.

On the other hand, since the accelerator pedal 42 is in the operated state to command the maximum target revolution speed NRmax, the modification effective/ineffective factor computing unit 57 computes K=1, and the multiplier 58 computes ΔN=ΔNA×1=ΔNA.

As a result, the subtractor 59 computes NT=NRmax−ΔNA. In other words, the target revolution speed for control is reduced by ΔNA from the revolution speed set by the accelerator pedal 42, and the engine control is performed based on that target revolution speed.

In FIG. 14, Ny represents the reduced target revolution speed (NT=NRmax−ΔNA), and TTJ represents the torque converter input torque at e=0.75, for example, after the engine revolution speed has been reduced.

In this embodiment, when the bucket 105 strikes against a thick or hard portion of the earth and sand, the pump pressure rises and the pump absorption torque is increased from TPE to TPF, which results in the increased working load. Simultaneously, as described above, the target revolution speed is reduced and the operating point of the traveling system 3 shifts from the point E to J. TPJ represents the torque converter input torque after the shift of the operating point. As a consequence, the actual engine revolution speed is reduced from NE at the point E to NF at the point J, and the traveling speed is also reduced correspondingly. Hence, the bucket 105 is able to gently excavate the thick or hard portion of the earth and sand while traveling at a slow speed, and to form a satisfactory flat excavation surface.

In FIG. 14, Ny represents the reduced target revolution speed (NT=NRmax−ΔNA), the operating point of the traveling system 3 shifts from the point E to J, and the actual engine revolution speed is reduced from NE at the point E to NF at the point J. TTJ represents a characteristic of the torque converter input torque at e=0.75, for example, after the engine revolution speed has been reduced, and TPJ represents the torque converter input torque after the shift of the operating point.

Thus, in this embodiment, when the bucket 105 strikes against a thick or hard portion of the earth and sand, the pump pressure rises and the pump absorption torque is increased from TPE to TPF, which results in the increased working load. Simultaneously, the target revolution speed is reduced and the operating point of the traveling system 3 shifts from the point E to J, whereby the actual engine revolution speed is reduced from NE to NF and the traveling speed is also reduced correspondingly. As a result, the bucket 105 is able to gently excavate the thick or hard portion of the earth and sand while traveling at a slow speed, and to form a satisfactory flat excavation surface. In addition, since the engine revolution speed is reduced, fuel economy can be improved.

According to this embodiment, as described above, the following advantages can be obtained. In the surface soil peeling-off work with the combined operation of the traveling and the working actuator, the work can be performed on the basis of the engine revolution speed intended by the operator. Also, when the working load increases, the engine revolution speed is automatically controlled so as to keep satisfactory combination in the combined operation of the traveling and the working actuator and to realize efficient work. In addition, since the engine revolution speed is reduced, fuel economy can be improved.

While the above embodiments have been described in connection with, as examples of work, the natural ground excavating work (first embodiment) and the surface soil peeling-off work (second embodiment), the present invention is not limited to those kinds of work.

For example, the second embodiment has been described in connection with the case of performing the surface soil peeling-off work by using the telescopic handler. However, the present invention is also applicable to the case of performing cleaning work with a sweeper mounted as the attachment. In the cleaning work using the sweeper, the telescopic handler travels while the sweeper is pressed against a road with the boom lowering operation, and the hydraulic motor 16 shown in FIG. 1 is rotated to rotate a sweeper brush such that droppings, such as rubbishes, on the road are collected into a hopper. In such work, the related art accompanies the problem that, because the engine revolution speed is not so changed even with an increase of substances to be removed, the traveling speed is not changed and some of the substances are left over. According to the system of the second embodiment, when the substances to be removed are increased in the cleaning work using the sweeper, the target revolution speed is automatically reduced and so is the actual engine revolution speed as in the case of the surface soil peeling-off work. Therefore, the traveling speed is slowed down and the substances to be removed are avoided from being left over.

Also, while the embodiments have been described as using the telescopic handler as the traveling hydraulic working machine, similar advantages can be similarly obtained in applications to other types of traveling hydraulic working machines so long as the machines include torque converters. Examples of the traveling hydraulic working machines equipped with torque converters, other than the telescopic handler, are a wheel shovel and a wheel loader.

Further, in the embodiments described above, the first modification revolution speed computing unit 52 or 52A receives the detected signal of the pump pressure from the pressure sensor 44, and determines the load state of the working system 2. Alternatively, a pressure sensor for detecting the driving pressure of the hydraulic actuator 13, etc. may be provided, and the first modification revolution speed computing unit 52 or 52A may receive a detected signal from that pressure sensor.

The first to third modification revolution speed computing units 52, 54, 55 or 52A, 54A, 55A each compute the modification revolution speed (value of 0 to 1) as a value for changing the engine revolution speed, and the subtractor 59 subtracts the modification revolution speed from the reference target revolution speed. Alternatively, it is also possible to provide a unit for computing a modification factor instead of the modification revolution speed computing unit, to provide a multiplier instead of the subtractor, and to multiply the reference target revolution speed by the modification factor, thereby obtaining the target revolution speed for control.

Moreover, in addition to the pump pressure, the boom-raising or boom-lowering pilot pressure is detected as means for detecting the operating situation of the working actuator, and the modification value of the engine revolution speed is determined depending on each of those pressures. In the case of going to control the engine revolution speed upon change of the working load regardless of the operating direction of the actuator, however, only the pump pressure may be detected to compute the modification revolution speed. In that case, the third modification revolution speed computing unit 55 or 55A is not required. Also, in the case of providing, as the means for detecting the operating situation of the working actuator, means for detecting operation signals generated from operating devices, two or more operation signals may be detected instead of detecting one operation signal (i.e., the boom-raising or boom-lowering pilot pressure). In that case, the operating situation of the working actuator can be confirmed with higher accuracy.

Additionally, when the work requiring the engine revolution speed to be controlled upon change of the working load is restricted to work of the type that the target revolution speed is always set to a high-speed range, the modification effective/ineffective factor computing unit 57 can be dispensed with.

INDUSTRIAL APPLICABILITY

According to the present invention, when a traveling hydraulic working machine is operated to perform work with the combined operation of traveling and a hydraulic actuator (working actuator), the revolution speed of a prime mover is controlled by modifying the target revolution speed inputted from input means, and therefore the work can be performed on the basis of the engine revolution speed intended by the operator. Also, even when the load pressure of the working actuator (i.e., the working load) varies depending on the working situation, the revolution speed of the prime mover is automatically controlled so that satisfactory combination can be kept in the combined operation of the traveling and the working actuator and efficient work can be realized.

The invention claimed is:

1. A traveling hydraulic working machine comprising at least one prime mover, a machine body for mounting said prime mover thereon, traveling means mounted on said machine body and including a torque converter coupled to said prime mover, a hydraulic pump driven by said prime mover, at least one working actuator operated by a hydraulic fluid supplied from said hydraulic pump, and an operating device for generating an operation signal to control said working actuator, said traveling hydraulic working machine further comprising:

input means for commanding a target revolution speed of said prime mover;

first detection means for detecting an operating situation of said working actuator;

second detection means for detecting an operating situation of said traveling means; and prime-mover revolution speed control means for modifying the target revolution speed of said prime mover based on the operating situation of said working actuator detected by said first detection means and the operating situation of said traveling means detected by said second detection means, and controlling the revolution speed of said prime mover, wherein said first detection means includes means for detecting at least one of a delivery pressure of said hydraulic pump and a driving pressure of said working actuator, and said first detecting means further includes means for detecting the operation signal generated from said operating device.

2. The traveling hydraulic working machine according to claim 1, wherein said second detection means is means for detecting input and output revolution speeds of said torque converter, and said prime-mover revolution speed control means includes means for computing a torque converter speed ratio from input and output revolution speeds of said torque converter, and determining the operating situation of said traveling means.

3. The traveling hydraulic working machine according to claim 1, wherein said prime-mover revolution speed control means includes means for computing a modification revolution speed of said prime mover when the operating situation of said working actuator detected by said first detection means and the operating situation of said traveling means detected by said second detection means come into respective particular states, and means for subtracting the modification revolution speed from the target revolution speed of said prime mover.

4. A traveling hydraulic working machine comprising at least one prime mover, a machine body for mounting said prime mover thereon, traveling means mounted on said machine body and including a torque converter coupled to said prime mover, a hydraulic pump driven by said prime mover, at least one working actuator operated by a hydraulic fluid supplied from said hydraulic pump, and an operating device for generating an operation signal to control said working actuator, said traveling hydraulic working machine further comprising:

input means for commanding a target revolution speed of said prime mover;

first detection means for detecting an operating situation of said working actuator;

second detection means for detecting an operating situation of said traveling means; and prime-mover revolution speed control means for modifying the target revolution speed of said prime mover based on the operating situation of said working actuator detected by said first detection means and the operating situation of said traveling means detected by said second detection means, and controlling the revolution speed of said prime mover, wherein said prime-mover revolution speed control means includes means for modifying the target revolution speed of said prime mover to reduce when the operating situation of said traveling means is in a state close to a stall of said torque converter and the operating situation of said working actuator comes into a light load state.

5. The traveling hydraulic working machine according to claim 4, wherein said first detection means includes means for detecting at least one of a delivery pressure of said hydraulic pump and a driving pressure of said working actuator.

6. The traveling hydraulic working machine according to claim 5, wherein said first detection means further includes means for detecting the operation signal generated from said operating device.

7. A traveling hydraulic working machine comprising at least one prime mover, a machine bock for mounting said prime mover thereon, traveling means mounted on said machine body and including a torque converter coupled to said prime mover, a hydraulic pump driven by said prime mover, at least one working actuator operated by a hydraulic fluid supplied from said hydraulic pump, and an operating device for generating an operation signal to control said working actuator, said traveling hydraulic working machine further comprising:

input means for commanding a target revolution speed of said prime mover;

first detection means for detecting an operating situation of said working actuator;

second detection means for detecting an operating situation of said traveling means; and prime-mover revolution speed control means for modifying the target revolution speed of said prime mover based on the operating situation of said working actuator detected by said first detection means and the operating situation of said traveling means detected by said second detection means, and controlling the revolution speed of said prime mover, wherein said prime-mover revolution speed control means includes means for modifying the target revolution speed of said prime mover to reduce when the operating situation of said traveling means is in a state far from a stall of said torque converter and the operating situation of said working actuator comes into a heavy load state.

8. The traveling hydraulic working machine according to claim 7, wherein said first detection means includes means for detecting at least one of a delivery pressure of said hydraulic pump and a driving pressure of said working actuator.

9. The traveling hydraulic working machine according to claim 8, wherein said first detection means further includes means for detecting the operation signal generated from said operating device.

10. A traveling hydraulic working machine comprising at least one prime mover, a machine body for mounting said prime mover thereon, traveling means mounted on said machine body and including a torque converter coupled to said prime mover, a hydraulic pump driven by said prime mover, at least one working actuator operated by a hydraulic fluid supplied from said hydraulic pump, and an operating device for generating an operation signal to control said working actuator, said traveling hydraulic working machine further comprising:

input means for commanding a target revolution speed of said prime mover;

first detection means for detecting an operating situation of said working actuator;

second detection means for detecting an operating situation of said traveling means; and prime-mover revolution speed control means for modifying the target revolution speed of said prime mover based on the operating situation of said working actuator detected by said first detection means and the operating situation of said traveling means detected by said second detection means, and controlling the revolution speed of said prime mover, wherein the traveling hydraulic working machine further comprising third detection means for detecting an input amount from said input means; and wherein said prime-mover revolution speed control means includes means for modifying the target revolution speed of said prime mover when the input amount detected by said third detection means is not smaller than a preset value.

11. The traveling hydraulic working machine according to claim 10, wherein said first detection means includes means for detecting at least one of a delivery pressure of said hydraulic pump and a driving pressure of said working actuator.

12. The traveling hydraulic working machine according to claim 11, wherein said first detection means further includes means for detecting the operation signal generated from said operating device.

* * * * *